US010807362B2

(12) United States Patent
Williams et al.

(10) Patent No.: US 10,807,362 B2
(45) Date of Patent: Oct. 20, 2020

(54) PRINTING SUBASSEMBLY

(71) Applicant: Hewlett-Packard Development Company, L.P., Spring, TX (US)

(72) Inventors: Kenneth Russell Williams, Vancouver, WA (US); Matt G Driggers, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/332,052

(22) PCT Filed: Sep. 12, 2016

(86) PCT No.: PCT/US2016/051335
§ 371 (c)(1),
(2) Date: Mar. 11, 2019

(87) PCT Pub. No.: WO2018/048446
PCT Pub. Date: Mar. 15, 2018

(65) Prior Publication Data

US 2019/0232652 A1 Aug. 1, 2019

(51) Int. Cl.
*B41J 2/14* (2006.01)
*B41J 29/02* (2006.01)
(Continued)

(52) U.S. Cl.
CPC ..... *B41J 2/14* (2013.01); *B41J 2/14024* (2013.01); *B41J 29/02* (2013.01); *B41J 29/13* (2013.01); *B41J 29/38* (2013.01)

(58) Field of Classification Search
CPC . B41J 2/14024; B41J 2/145; B41J 2/16; B41J 2/155; B41J 2/2146; B41J 2/515; B41J 2/2103; B41J 2202/20; B41J 2202/21; B41J 3/54; B41J 3/60; B41J 3/543; B41J 25/34; B41J 1/16; B41J 1/20
See application file for complete search history.

(56) References Cited

U.S. PATENT DOCUMENTS 4,662,765 A 5/1987 Kapp et al.
4,795,284 A 1/1989 Yumoto et al.
(Continued)

FOREIGN PATENT DOCUMENTS

EP 1016938 7/2000
JP 2001219620 8/2001
(Continued)

*Primary Examiner* — Juanita D Jackson
(74) *Attorney, Agent, or Firm* — Dicke Billig & Czaja PLLC

(57) ABSTRACT

An example printing subassembly includes a frame having first and second members spaced extending in a first direction. The frame can be removably coupled to a printing device. The first and second members are spaced from each other in a second direction, which is orthogonal to the first direction. The first and second directions are also orthogonal to a third direction. A printbar is coupled to the frame. An alignment system is coupled to the frame and includes at least four alignment features cooperating to constrain translation of the printing subassembly in the third direction and rotation about axes in the first and second directions with respect to the printing device.

15 Claims, 5 Drawing Sheets

(51) Int. Cl.
*B41J 29/38* (2006.01)
*B41J 29/13* (2006.01)

(56) References Cited

U.S. PATENT DOCUMENTS

| | | | |
|---|---|---|---|
| 6,340,256 | B1 | 1/2002 | McKay et al. |
| 7,621,620 | B2 | 11/2009 | Brown et al. |
| 7,837,297 | B2 | 11/2010 | Brown et al. |
| 8,205,965 | B2 | 6/2012 | Scheffelin et al. |
| 8,235,484 | B2 | 8/2012 | Ray et al. |
| 8,388,094 | B2 | 3/2013 | Rosati et al. |
| 9,283,764 | B2 | 3/2016 | Campillo et al. |
| 2006/0044380 | A1 | 3/2006 | Takeshi et al. |
| 2007/0126776 | A1 | 6/2007 | Silverbrook et al. |
| 2008/0129813 | A1 | 6/2008 | Park et al. |
| 2009/0295872 | A1* | 12/2009 | Ray et al. ..... B41J 2/155 |
| 2012/0194607 | A1* | 8/2012 | Iwasa et al. ..... B41J 2/16505 |
| 2015/0185149 | A1 | 7/2015 | Jin et al. |

FOREIGN PATENT DOCUMENTS

| | | | |
|---|---|---|---|
| JP | 2011093174 | | 5/2011 |
| JP | 2011230394 | | 11/2011 |
| JP | 2011240552 | | 12/2011 |
| WO | WO-2006066302 | A1 | 6/2006 |
| WO | WO-2011002747 | A2 | 1/2011 |

* cited by examiner

PRINTING SUBASSEMBLY

BACKGROUND

Printing devices—including printers, copiers, fax machines, multifunction devices including additional scanning, copying, and finishing functions, all-in-one devices, or other devices such as pad printers to print images on three dimensional objects and three-dimensional printers (additive manufacturing devices)—receive digital images or digital models and produce objects or images on media such as paper, polymeric materials, and other media. Images can be obtained directly from the printing device or communicated to the printing device from a remote location such as from a computing device or computing network. In the example of a sheet fed device, a sheet is selected from the media stack, typically one item at a time, and fed through a media support along a feedpath to an output tray. In a roll fed device, a web of media is fed through a media support along the feedpath to an output. The media interacts with printheads at the media support to produce images on the media. Three-dimensional printers receive a digital model or other data source of an object and can form successive layers of material to produce a three-dimensional object, such as via printer heads, extrusion, sintering-based processes or other processes.

DETAILED DESCRIPTION

Figure 1:
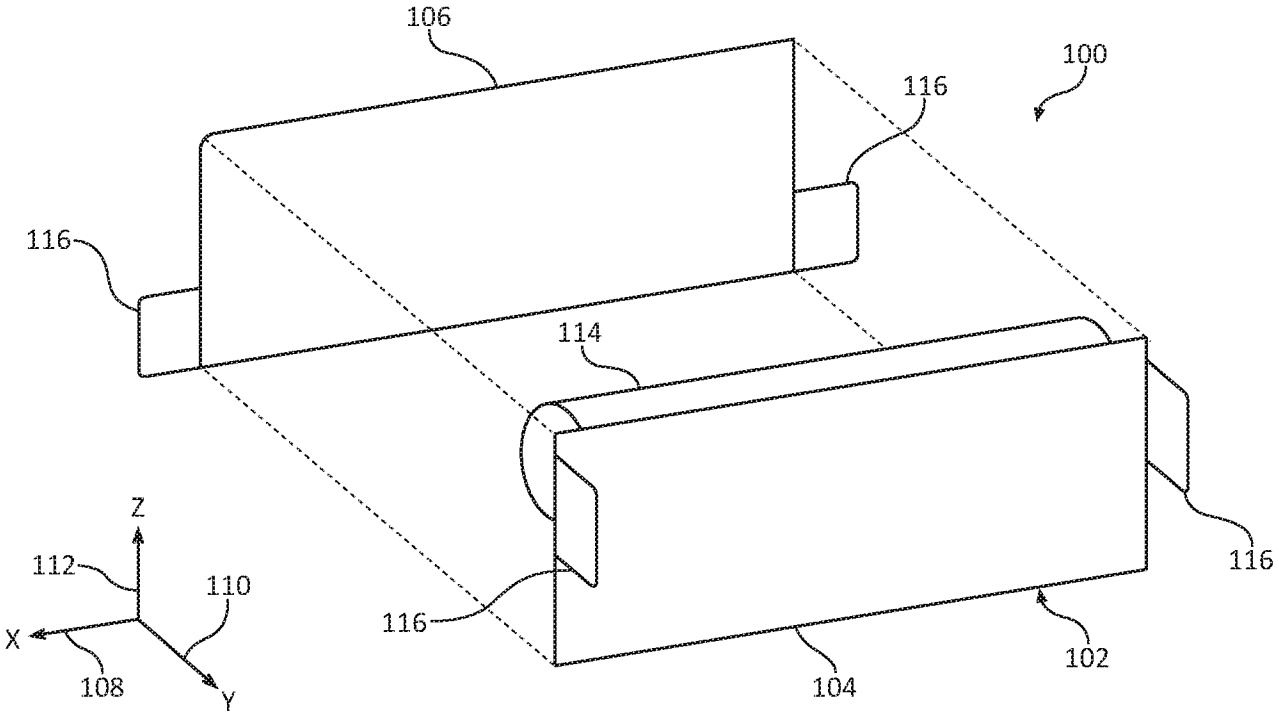
FIG. 1 is a perspective view illustrating an example printing subassembly.

Many printing devices, such as commercially-used inkjet printers in offices, schools, and laboratories, are repaired on site rather than being returned to a factory. A technician is often dispatched in short order to the printing device where the maintenance is performed based on a service contract. If repairs are too frequent and too involved, business suffers or users become frustrated with the inability to use the printing device or the expense of the service contract.

In many examples, commercially used printing devices are sturdily built but difficult to repair. In one example, a printing device may have a difficult to repair printbar, which includes a set of print heads spanning a width of media and may be prone to fail from time to time. The repair of a printbar may involve initially removing the scanner or document feeder and disassemble part of the components of the feedpath and data cables. If a printbar has failed or is in disrepair, it is likely that associated parts such as drive motors, gears, bearings, and other features are also nearing the end of service life. These parts can also be difficult to repair and are also replaced one-by-one often in separate service visits. The repair of difficult to access small parts at disparate service intervals can lead to costly repair visits for relatively inexpensive components, repeated service visits, and long repair times.

In order to address some of these concerns, the print bar can be carried on a frame and included as part of a replaceable and modular printing subassembly. The printing subassembly may include components to one or more of hold, move, protect, or supply marking material to the printbar. For example, other parts carried on the frame can include a lift mechanism and delivery system for marking material, such as ink, to the printbar. The printbar and related components are not intended to be repaired or individually replaced in the field. Instead, the entire printing subassembly can be removed from the printing device as a unit and replaced with a new subassembly installed into the printing device.

In general, six points of contact may be used to correctly position and fully constrain a rigid printing subassembly within a printing device in all six degrees of freedom of motion. In particular, three points of contact often form a primary, Z datum, two points of contact form a secondary, Y datum, and one point of contact forms a tertiary, X datum. The three primary, Z datum contact points stop translation in the Z direction and rotation about the X and Y axes. Two secondary, Y datum points stop translation in the Y direction and rotation about the Z axis. A single, tertiary, X datum point stops translation in the X direction. The rigid printing assembly having six points of contacts will mate with corresponding features on a printing device chassis but is susceptible to permanent deformation—such as during manufacturing, transport or installation—which can cause the internal components of the printing subassembly to become misaligned from nominal with respect to corresponding printing components in the printing device.

FIG. 1 illustrates an example printing subassembly 100. The example printing subassembly includes a frame 102 having first and second members 104, 106, spaced extending in a first direction 108. The frame 102 can be removably coupled to a printing device (not shown). The first and second members 104, 106 are spaced from each other in a second direction 110, which is orthogonal to the first direction 108. The first and second directions 108, 110 are also orthogonal to a third direction 112. A printbar 114 is coupled to the frame 102. The example printing subassembly 100 illustrates an elongated printbar 114 extending in the first direction 108 with respect to the members 104, 106. In another example, the printbar 114 can extend in the second direction 110 with respect to the members 104, 106, or in another configuration. An alignment system 116 is coupled to the frame 102 and includes at least four alignment features cooperating to constrain translation of the printing subassembly 100 in the third direction 112 and rotation about axes in the first and second directions 108, 110 with respect to the printing device.

Figure 2:
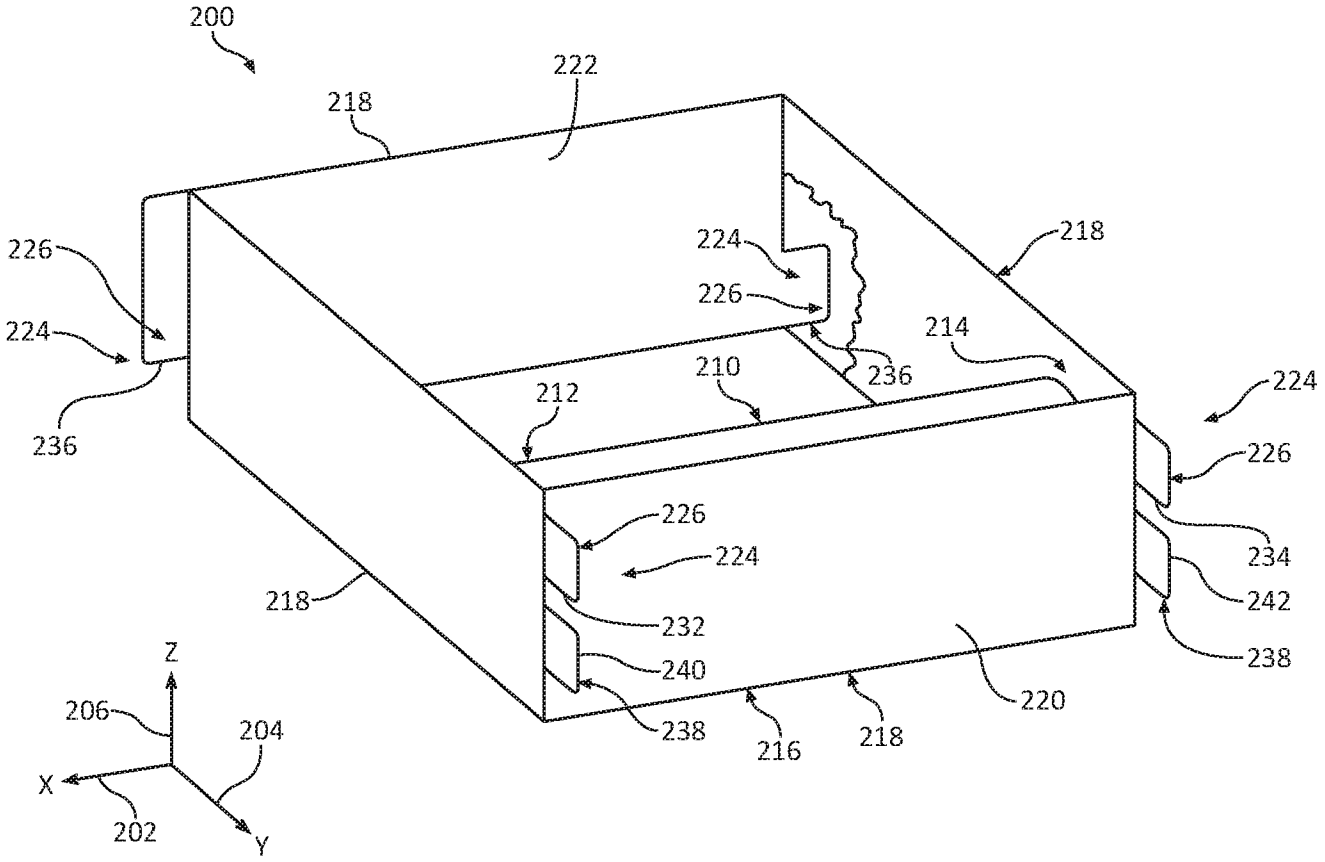
FIG. 2 is a perspective view illustrating another example printing subassembly

FIG. 2 [HN1]illustrates an example printing subassembly 200 that can be removably coupled to a printing device (not shown). Exemplars of the printing device can include one or combinations of two or more of a printer, scanner, copier, fax machine, plotters, or other devices such as pad printers or three-dimensional printers. The printing device can be operated as one or combinations of two or more of a stand alone device, a device coupled to a computer network, or a peripheral or auxiliary device operated by a computer or other processing device. In one example, the printing device is a commercially-used inkjet printer. Print media can include paper, plastic, fabric, in various sizes and types, such as 8.5 by 11 inch paper, A4 paper, roll feed media, and other media.

For reference, the printing subassembly is included in a space having a first direction 202, or X direction, a second direction 204, or Y direction orthogonal to the first direction 202, and a third direction 206, or Z direction orthogonal to the first and second directions 202, 204.

The printing subassembly 200 includes an elongated printbar 210 extending along the first direction 202. The printbar 210 includes a first end region 212 and a second end region 214.

The printbar 210 can include a printing portion intended to print on the media. The printing portion of the printbar 210 spans the width of the media intended for printing, and the width of the media can extend along the first direction 202. For example, a printing portion can be at or over 8.5 inches long for a letter size (8.5 inches by 11 inches) sheet of media. The printbar 210 can include multiple print dice in a print head and multiple print heads spanning the width of the printing portion. Accordingly, the print heads do not move across the width of the media during printing. In one example, a die can be configured to print cyan and magenta and another die can be configured to print black and yellow. These dice can be coupled together in a print head, and multiple print heads are positioned in a media-wide, or page-wide, array, on the print portion.

A frame 216 is operably coupled to the printbar 210. In the example, the frame 216 has a plurality of members 218 forming a box around at least a portion of the printbar 210, although other configurations are contemplated. The frame 216 includes an elongate first member 220 extending in the first direction 202 and proximate the printbar 210. A second member 222 is operably coupled to the first member 220, such as attached via additional members 218, and includes a portion spaced apart in the second direction 204 from the first member 220. In the example, the entire second member 222 is spaced apart from the first member 220. Also, the example illustrates the printbar 210 disposed between the first and second members 220, 222, although other configurations are possible.

An alignment system 224 is coupled to the frame 216. The alignment system 124 includes at least four third-direction alignment features 226 on the frame 216 to form points of contact for a primary datum to constrain the alignment subassembly in the third direction, i.e., to stop translation of the printing subassembly in the third direction 206 and rotation of the subassembly 200 about axes in the first and second directions 202, 204 while installed in the printing device. In the example, the third-direction alignment features 226 include a first locating feature 232 proximate the first end region 212 and a second locating feature 234 proximate the second end region 214. The third-direction alignment features 226 further include a plurality of locating features 236 proximate the second member 222. The third-direction alignment features 226 are configured to mate with or attach to corresponding features in the printing device, such as formed on a chassis of the printing device, to constrain the printing subassembly 200. In one example, some or all of the third-direction alignment features 226 are held in place with respect to the printing device via gravity.

The alignment system 224 includes at least two second-direction alignment features 238 on the frame 216 to form points of contact for a secondary datum to constrain the printing subassembly 200 in the second direction, i.e., to stop translation of the printing subassembly 200 in the second direction 204 and rotation of the subassembly 200 about axes in the third direction 206 while installed in the printing device. The second direction alignment features 238 including a first second-direction alignment feature 240 proximate the first locating feature 232 and the first end region 212 and a second second-direction alignment feature 242 proximate the second locating feature 234 and the second end region 214.

Examples of the second-direction and third-direction alignment features 238, 226 can include protuberances, bosses, pads, or tabs extending from the frame 216 or openings such as slots formed in the frame 216 or holes for receiving mounting screws to attach the frame to a chassis of the printing device. For example, tabs can include edges, flanges, cut features in the frame 216. Other examples are contemplated. In one example, the third-direction alignment features can include tabs in the frame and the second-direction alignment features can include a combination of tabs in the frame and holes for receiving mounting screws.

In some examples, the alignment system 224 includes at least one first-direction alignment feature on the frame to form a point of contact for a tertiary datum to constrain the printing subassembly 200 in the first direction, i.e., to stop translation of the printing subassembly 100 in the first direction 202. In one example, the first-direction alignment features can include holes for receiving mounting screws. Other examples are contemplated.

In an example printing subassembly 200, at least four points of contact (i.e., the third-direction alignment features 226) on frame 216 form the primary, Z datum. The printing subassembly 200 includes a deformable frame 216, or slightly flexible frame 216, such that the four points of contact 226 can mate with the corresponding features on the printing device even if the features are misaligned from nominal according to tolerances. A three-point contact system to form the primary datum would include a substantially more rigid frame manufactured at strict tolerances, which would increase complexity and cost as well as being susceptible to misalignment if the rigid frame became deformed during transport or installation.

Figure 3:
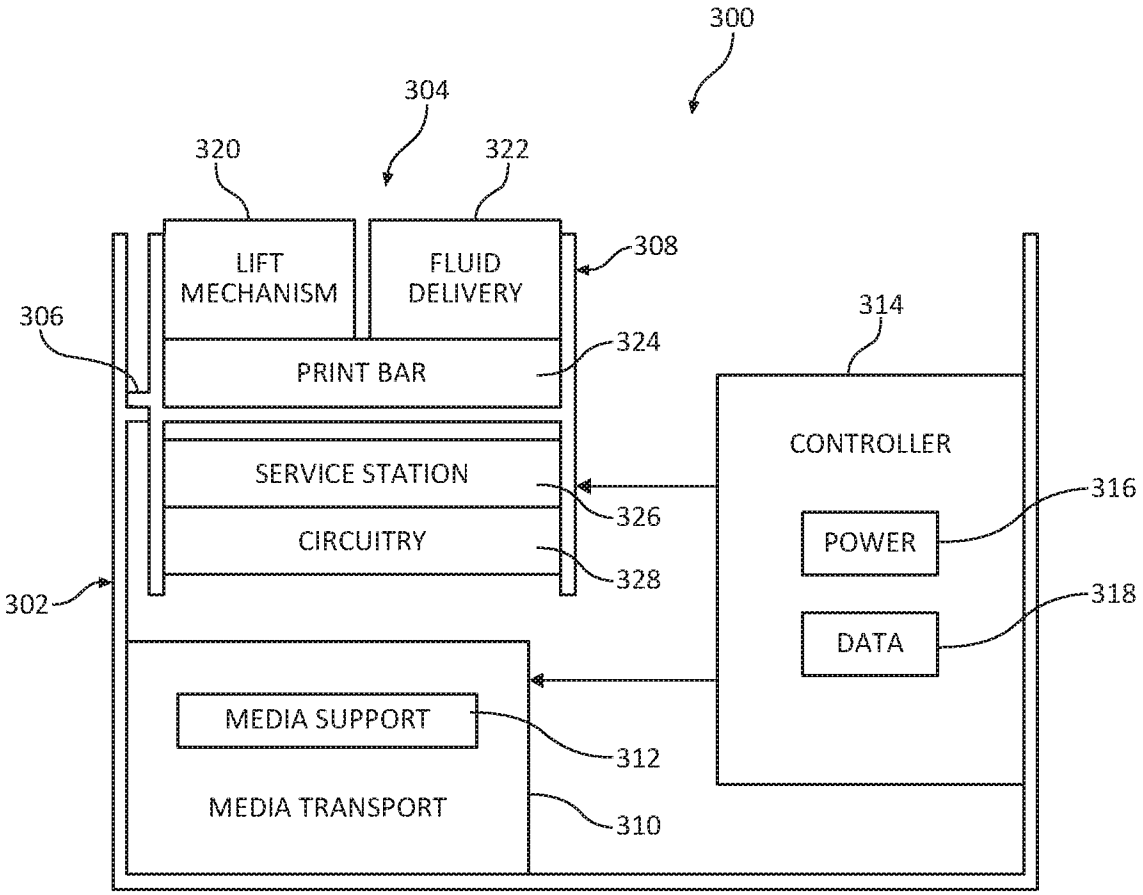
FIG. 3 is a schematic diagram illustrating an example of a replaceable printing subassembly of FIG. 1 for a printing device.

FIG. 3 illustrates an example printing device 300 having a chassis 302 operably coupled to an installed replaceable printing subassembly 304, which generally corresponds with printing subassembly 200, via an alignment system 306 on frame 308, which generally corresponds with alignment system 224 on frame 216.

The printing device 300 can include an media transport system 310 having a media support 312 adapted to present media for marking with the printing subassembly 304. The media transport system 310, as well as other components of the printing device 300, can be coupled to, or move with respect to the chassis 302. The media transport system 310 can include mechanisms to deliver media in the form of one of sheets or a web roll to the subassembly 304. A controller 314, including a processor, memory, and can include communication circuitry and other features, is coupled to the media transport system 310 to control the media transport system 310. The controller 314 can include a power circuit 316 and image processing circuitry 318 coupled to the printing subassembly 304 to provide power and data, such as image data, to operate the subassembly 304. In one example, the controller 314 provides power and data signals to the subassembly 304 via electrical connections, optical connections, or both. For instance, the controller can provide power and data via detachable electrical conductors electrically coupled to the subassembly 304.

The printing subassembly 304 in the example includes a lift mechanism 320 and fluid delivery system 322 coupled to the frame 308. A printbar 324, generally corresponding with printbar 210 is in fluid communication with the fluid delivery system 322, and operably coupled to the lift mechanism 320. The fluid delivery system 322, which may include a pump in one example, can be coupled to a fluid supply, such as a replaceable or refillable ink supply 326. The lift mechanism 320, powered by the controller 314, positions the printbar 324 in a first position with respect to the print media on the media support 312 for printing. In this aspect, the lift mechanism 320 is coupled to the printbar 324 and frame 308 to selectively position the printbar 324 with respect to the chassis 302. For example, the lift mechanism 320 can include motors, drives, and guides. Positioning of the printbar 324 can be based on the type of media in media transport system 310. The lift mechanism 320 can also position the printbar 324 in a second position with respect to the media support 312 when not printing or marking on media.

In some examples, the printing subassembly 304 can include additional components coupled to the frame 308 such as a service station 326 or a repositionable headlock 328 to protect the print heads on the printbar 324 during transport. The service station 326 includes mechanisms such as drives and wipers to clean and preserve the functionality of the print heads and to cap print heads when not in use.

Further, the printing subassembly 304 can include related circuitry 330 and electrical connections. In one example, the circuitry 330 can include a storage medium such as a computer memory that can include information, stored in digital form, regarding the particular printing subassembly 302. The circuitry 330 can be read by the controller 314, for example, or other processing circuitry on the printing subassembly 304, printing device 300, computing device connected to the printing device 300 via computer network, or elsewhere operably coupled to the printing device 300. Information stored on circuitry 330 can include offset from nominal of the printbar 324 as a result of manufacturing tolerances or other imperfections in manufacturing of components of the printing subassembly or otherwise affecting the alignment of the printbar 324 with respect to the media support 312, or pen-to-paper spacing.

In one example, the printing device 300 can read the information regarding printbar offset stored in the circuitry 330 and adjust a printbar positioning system, which can be driven by controller 314, to provide a suitable alignment of the printbar 324 to media support 312. The information regarding printbar offset can provide an alternative to particular calibrations or adjustments made during installation of the printing subassembly 302 into printing device 300 by factory workers or field service personnel.

Figure 4:
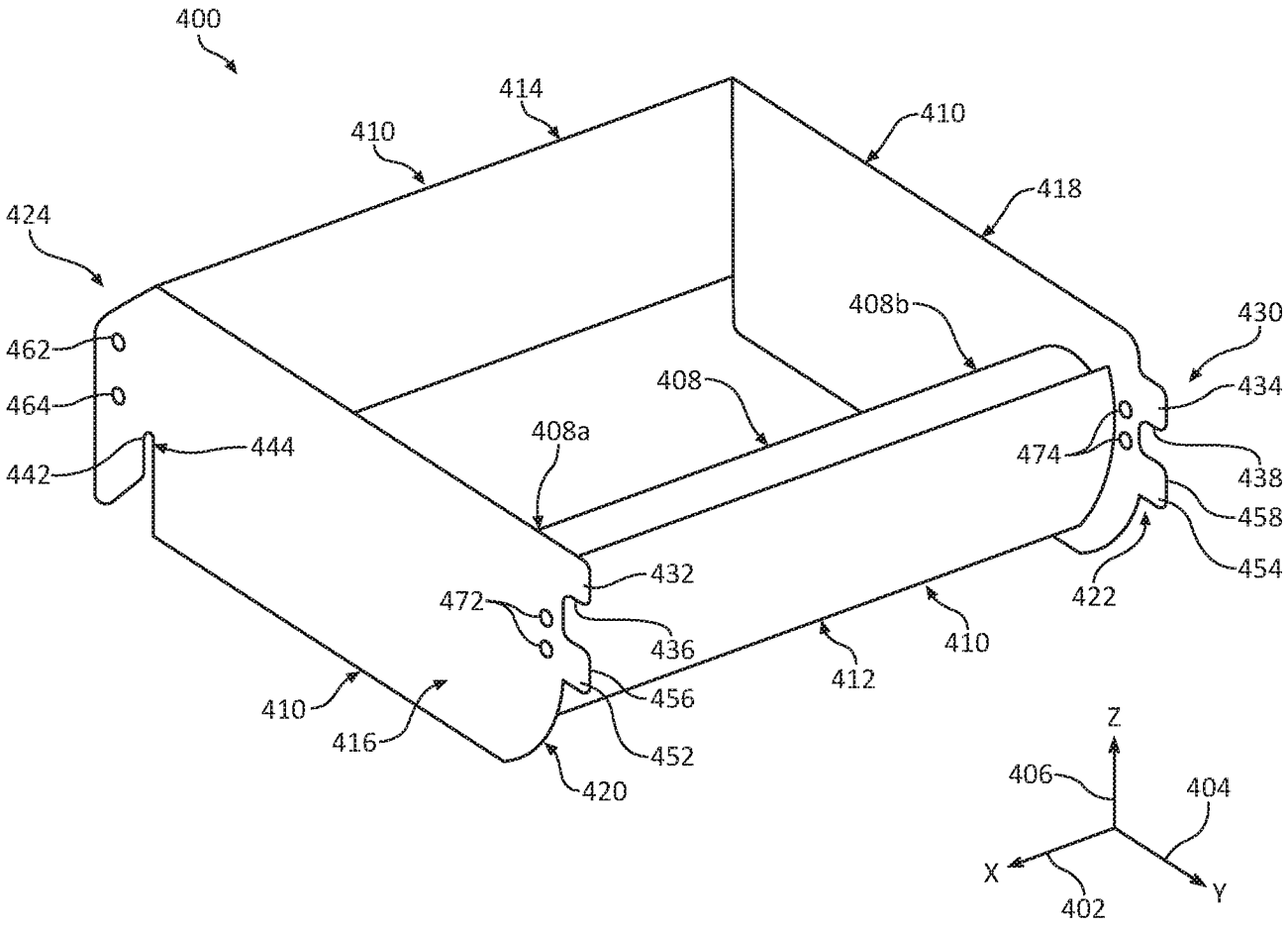
FIG. 4 is a perspective view illustrating portions of an example printing subassembly including features of the printing subassembly of FIG. 1.
Figure 5:
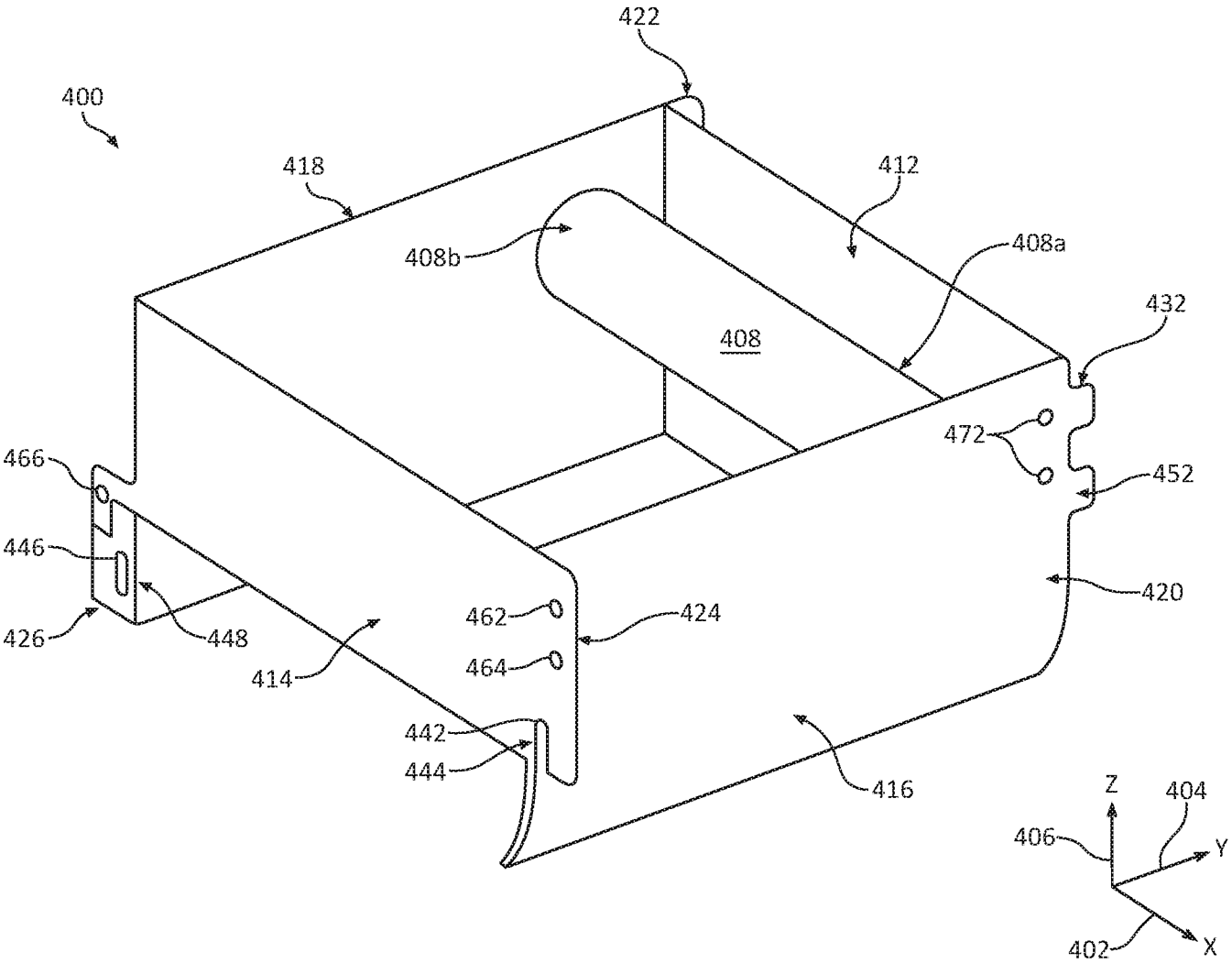
FIG. 5 is another perspective view illustrating portions of the example printing subassembly of FIG. 3 including features of the printing subassembly of FIG. 1.

FIGS. 4 and 5 illustrate an example of frame 400, which can correspond with frame 116 printing subassembly 110 or frame 208 of printing subassembly 202. For reference, the frame 400 is included in a space having a first direction 402, or X direction, a second direction 404, or Y direction orthogonal to the first direction 402, and a third direction 406, or Z direction orthogonal to the first and second directions 402, 404.

Frame 400 includes a plurality of members 410. In the example, the members 410 are configured as elongated walls generally upstanding in the third direction 406. The members 410 include a first wall 412 extending along the first direction 402 spaced apart from a second wall 414. A third wall 416 is attached to the first and second walls 412, 414, and the third wall 416 is spaced apart from a fourth wall 418, which is also attached to the first and second walls 412, 414. The walls can be attached together in a suitable manner such as by welding or with fasteners and can be formed from suitable materials such as aluminum, steel, other sheet metal, plastics or other materials.

FIG. 4 illustrates the third and fourth walls 416, 418 in the example include forward portions 420, 422 respectively, extending in the second direction 404 past the first wall 412. In other examples, forward portions 420, 422 can be formed from bending ends of the first wall 412 in the direction of the third and fourth walls 416, 418. Other examples are contemplated.

Frame 400 also includes first flange 424 formed proximate a junction of the second wall 414 and third wall 416. In one example, first flange 424 is formed as a cutout of the second wall 414 extending past the third wall 416 and can include a cutout of the third wall 416 bent to be generally perpendicular to the general plane of the third wall 416 and overlapping or partially overlapping the cutout of the second wall 414.

FIG. 5 illustrates a second flange 426 formed proximate a junction of the second wall 414 and the fourth wall 418. In one example, flange 426 is formed as a cutout of the second wall 414 extending past the fourth wall 418 and can include a cutout of the fourth wall 418 bent to be generally perpendicular to the general plane of the fourth wall 418 and overlapping or partially overlapping the cutout of the second wall 414.

In the example, a printing subassembly is configured to operably couple an elongate printbar 408, to span along the first direction 402 and proximate the first wall 412. For example, the printbar 408 can be located within the box proximate the first wall 412. Other configurations are possible, such as the printbar 408 disposed underneath the first wall in a printing subassembly. Forward portions 420, 422 are disposed proximate end regions 408*a*, 408*b* of the printbar 408.

Frame 400 includes an alignment system 430 to constrain the frame 400 in all six degrees of freedom of motion with respect to a chassis in a printing device. In one example, alignment system 430 can be one of or a combination of attached to the members 410, formed in the members 410, or otherwise included on the frame 400.

FIG. 4 illustrates the forward portions 420, 422 include tabs 432, 434, respectively, having undersurfaces 436, 438, respectively, as third-direction alignment features. FIG. 5 illustrates the second wall 416 includes an undersurface 442 in a first slot 444 proximate the first flange 424 and also includes an undersurface 446 in a second slot 448 proximate the second flange 426 as third-direction alignment features.

Undersurfaces 436, 438, 442, 446 are configured to lie on or rest against corresponding mating surfaces on a chassis of the printing device to provide constraint for translation of the frame 400 in the third direction 406 and to provide constraint for rotation of the frame 400 about axes in the first and second directions 402, 404. For example, the undersurfaces 436, 438 of tabs 432, 434 can lie on tabs formed on or attached to the chassis. Also, the chassis can include tabs to fit into the first and second slots 444, 448 such that the undersurfaces 442 and 446 rest on top of tabs.

In the example, frame 400 is sufficiently flexible to allow undersurfaces 436, 438, 442, 446 to lie on the corresponding mating surfaces via gravity or biasing if all four third-direction alignment features are not manufactured precisely at nominal and within tolerances, but sufficiently rigid to prevent sagging or wobble once the frame 400 has been installed in the printing device. In contrast, an alignment system having precisely three third-direction alignment features is manufactured with substantially more rigidity in the frame, less tolerance for misalignment, and thus is transported with substantial protective packaging to prevent deformations. The sufficiently flexible frame 400 with the four-point third-direction alignment features provides for less costly materials, manufacture, and shipping.

In the example, two of the third-direction alignment features, i.e., undersurfaces 436, 438 of tabs 432, 434, are provided on the frame 400 proximate the printbar 408, particularly nozzles on the print heads, to properly locate the subassembly. In one example, the undersurfaces 436, 438 are provided proximate the printbar end regions 408*a*, 408*b*, such as at or near the junction of the first and third walls 412, 416 and first and fourth walls 412, 418.

Further, an additional two of the third-direction alignment features, i.e., undersurfaces 442, 446 of slots 444, 448, are provided on the frame 400 distal to the printbar 408. Accordingly, the positioning of the printbar 408 is less sensitive to affects of manufacturing tolerances for undersurfaces 442, 446 and the corresponding mating features on the chassis. The third-direction alignment features of undersurfaces 442, 446 can be manufactured with sufficient accuracy to provide general alignment for non-printing functions of the subassembly, but the remote location from the printbar 408 reduces printing alignment affects.

The alignment system can be formed by cutting or punching sheet metal, such as undersurfaces 436, 438, 442, 446, allows the alignment system to be configured during the same manufacturing cutting or punching operation as other locating or mounting features of the frame 400. Further, the corresponding mating surfaces on the chassis can be formed via cutting or punching operations to provide cut-edge to cut-edge contact when the printing subassembly is installed into printing device. Cut-edge to cut-edge contact provides substantial accuracy in locating the frame 400 via the chassis.

FIG. 4 illustrate the forward portion 420, 422 include tabs 452, 454, respectively having side surfaces 456, 458, respectively, as second-direction alignment features. FIG. 5 illustrates the first flange 424 includes holes 462, 464 for receiving screws and the second flange 426 includes hole 466 for receiving screws. Side surfaces 456, 458 of tabs 452, 454 are configured to press against or abut corresponding mating surfaces on the chassis, and screws in holes 462, 464, 466 are configured to draw the frame 400 to the chassis to hold the side surfaces 456, 458 of tabs 452, 454 against the corresponding mating surfaces on the chassis to provide constraint for translation of the frame 400 in the second direction 404 and to provide constraint for rotation of the frame 400 about an axis in the third direction 406.

Slots 444, 448, in addition to providing third-direction alignment features, can also provide first-direction alignment features. In this example, chassis tabs configured to fit in first and second slots 444, 448 to constrain translation in the third direction can include side surfaces to abut against the lateral edges of slots 444, 448 and provide constraint from translation of the frame 400 in the first direction 402. In addition to slots 444, 448, the third and fourth walls 416, 418 can include receiving holes for mounting screws, such as receiving holes 472, 474 on forward portions 420, 422, respectively, such that the mounting screws can draw the frame 400 to the chassis and provide constraint for translation in the first direction 402.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A printing subassembly removably coupleable to a printing device, the printing subassembly comprising:

a frame having first and second members extending in a first direction, the first and second members spaced apart in a second direction orthogonal to the first direction, the first and second directions are orthogonal to a third direction, the frame being removably coupleable to a chassis of the printing device;

a printbar coupled to the frame; and an alignment system coupled to the frame having at least four alignment features to engage the chassis and cooperate to constrain translation of the printing subassembly in the third direction and rotation about axes in the first and second directions with respect to the printing device, the at least four alignment features having at least two features extending from the frame in a first direction and at least two features disposed in the frame along a second direction.

2. The printing subassembly of claim 1 comprising a fluid delivery system coupled to the printbar.

3. The printing subassembly of claim 2 wherein the fluid delivery system includes a pump.

4. The printing subassembly of claim 2 further comprising a service station coupled to the frame and a lift mechanism coupled to the printbar and frame to selectively position the printbar with respect to the chassis.

5. The printing subassembly of claim 1 wherein the print bar includes a printbar element having a width and a plurality of dice spanning the width of the printbar element.

6. The printing subassembly of claim 1 wherein the printbar is disposed within the frame.

7. The printing subassembly of claim 1 wherein the first and second members include walls upstanding in the third direction.

8. The printing subassembly of claim 1 wherein the alignment system includes first and second locating features include tabs formed in the frame.

9. A printing subassembly removably coupleable to a printing device, the printing subassembly, the printing subassembly comprising a frame having first and second members extending in a first direction, the first and second members spaced apart in a second direction orthogonal to the first direction, the first and second directions are orthogonal to a third direction;

an elongated printbar coupled to the frame proximate the first member, the printbar having first and second end regions; and an alignment system coupled to the frame proximate the first and second members to engage a chassis of the printing device, the alignment system having at least four alignment features cooperating to constrain translation of the printing subassembly in the third direction and rotation about axes in the first and second directions with respect to the chassis of the printing device, the alignment features including a first alignment feature proximate the first end region and a second alignment feature proximate the second end region, the at least four alignment features having at least two features extending from the frame in a first direction and at least two features disposed in the frame along a second direction.

10. The printing subassembly of claim 9 wherein the first and second alignment features include flanges formed in the frame, the flanges having edges.

11. The printing subassembly of claim 9 wherein the frame further includes alignment features constraining translation in the second direction and rotation about an axis in the third direction.

12. The printing subassembly of claim 9 further including third and fourth alignment features includes slots formed in the frame.

13. The printing subassembly of claim 12 wherein the slots form alignment features constraining translation in the first direction.

14. A printing device, comprising:

a chassis;

a media support mechanism coupled to the chassis; and a replaceable printing subassembly removably coupled to the chassis, the printing subassembly, comprising a frame having first and second members extending in a first direction, the first and second members spaced apart in a second direction orthogonal to the first direction, the first and second directions are orthogonal to a third direction, the frame being removably coupleable to a printing device;

a printbar coupled to the frame; and an alignment system coupled to the frame having at least four alignment features to engage the chassis, the alignment system to cooperate to constrain translation of the printing subassembly in the third direction and rotation about axes in the first and second directions with respect to the printing device, the at least four alignment features having at least two features extending from the frame in a first direction and at least two features disposed in the frame along a second direction.

15. The printing device of claim 14 wherein the printing device is an inkjet printer.

* * * * *